US006201519B1

(12) United States Patent
Chevet et al.

(10) Patent No.: US 6,201,519 B1
(45) Date of Patent: Mar. 13, 2001

(54) PROCESS AND DEVICE FOR ADDRESSING PLASMA PANELS

(75) Inventors: Jean-Claude Chevet, Betton; Didier Doyen, La Bouexiére; Dominique Touchais, La Bouéxiére, all of (FR)

(73) Assignee: Thomson multimedia, Boulogne (FR)

( * ) Notice: Subject to any disclaimer, the term of this patent is extended or adjusted under 35 U.S.C. 154(b) by 0 days.

(21) Appl. No.: 09/259,901

(22) Filed: Feb. 26, 1999

(30) Foreign Application Priority Data

Mar. 23, 1998 (FR) ..... 98 03548

(51) Int. Cl.[7] ..... G09G 3/28

(52) U.S. Cl. ..... 345/63; 345/60; 345/147; 345/149

(58) Field of Search ..... 345/60–68, 37, 345/41, 55, 89, 147, 148, 432, 149; 315/169.4; 348/797

(56) References Cited

U.S. PATENT DOCUMENTS

| | | | | |
|---|---|---|---|---|
| 5,475,448 | | 12/1995 | Saegusa | 348/797 |
| 5,848,198 | * | 12/1998 | Penn | 382/276 |
| 5,999,154 | * | 12/1999 | Yoshioka | 345/89 |
| 6,091,380 | * | 7/2000 | Hashimoto et al. | 345/60 |

FOREIGN PATENT DOCUMENTS

| | | |
|---|---|---|
| 0762373 | 3/1997 | (EP) . |
| 8-248916 | 9/1996 | (JP) . |

OTHER PUBLICATIONS

"Vertical Reference Coding For Digital Gray Level Images", IBM Technical Disclosure Bulletin, Dec. 1979, vol. 22, Issue 7, pp. 2980–2985.*

* cited by examiner

*Primary Examiner*—Richard A. Hjerpe
*Assistant Examiner*—Alexander Eisen
(74) *Attorney, Agent, or Firm*—Joseph S. Tripoli; Harvey D. Fried; Sammy S. Henig

(57) ABSTRACT

A process for addressing cells of a plasma panel includes the step of coding the grey levels NG1 and NG2 relating to an item of information regarding the luminance of two cells situated in the same column and in two adjacent lines I and I+1. The grey levels NG1 and NG2 are coded as a first control word corresponding to a common value VC and as a second control word and a third control word corresponding to specific values, VS1 and VS2. The coding is such that, NG1=VS1+VC and NG2=VS2+VC. The process further includes the step of transmitting the bits of the first control word on the column inputs by simultaneously addressing the two lines I and I+1 in respect of the selection of the corresponding cells.

17 Claims, 1 Drawing Sheet

PROCESS AND DEVICE FOR ADDRESSING PLASMA PANELS

FIELD OF THE INVENTION

The invention relates to an addressing process and device for plasma panels and in particular to a grey level coding process.

BACKGROUND OF THE INVENTION

On plasma screens, the grey level is not produced in a conventional manner using amplitude modulation of the signal but rather temporal modulation of this signal, by exciting the corresponding pixel for a greater or lesser time depending on the level desired. It is the phenomenon of integration by the eye which makes it possible to render this grey level. This integration is performed during the frame scan time.

The eye actually integrates much faster than the frame duration and is therefore liable to perceive, in cases of particular transition of the addressing bits, variations in level which do not reflect reality. Contour defects or "contouring" as it is known, may thus appear in the moving images. These defects may be compared to poor temporal restitution of the grey level. More generally, false colours appear on the contours of objects, each of the cells of a colour component possibly being subject to this phenomenon. This phenomenon is even more harmful when it occurs in relatively homogeneous zones.

A simple theoretical solution for limiting these problems of the appearance of false contours is to multiply the number of sub-scans so that the disturbances related to the modifications of the video level from one frame to another are made minimal. Such a solution has formed the subject of a patent application in France filed by the Applicant on Apr. 25, 1997 under national registration number 97 05166. By virtue of the simultaneous addressing of two consecutive lines in respect of bits of the column addressing word and by virtue of the sub-scans thus saved, allowing transcoding of the column control words over a greater number of bits, it is possible to reduce the weights of the most significant bits.

The losses of resolution which are caused by this may be limited by using the redundancy possibilities of the codes for the recoding of the grey level. However, it is not possible to curb the magnitude of these losses of resolution.

The purpose of the invention is to alleviate the aforesaid drawbacks.

SUMMARY OF THE INVENTION

Its subject is a process for addressing cells arranged as a matrix array, each cell being situated at the intersection of a line and a column, the array having line inputs and column inputs for displaying grey levels NG defined by video words making up a digital video signal, the column is inputs receiving control words for this column, each bit of a control word triggering or not triggering, depending on its state, the selection of the cell of the addressed line and of the corresponding column for a time proportional to the weight of this bit within the word, characterized in that it consists:

in splitting up the grey levels NG1, NG2, . . . , NGn relating to an information item regarding the luminance of n cells situated in the same column and in consecutive lines I+1 to I+n into at least one control word corresponding to a value common to the n lines, VC, and into n control words corresponding to values specific to each line, VS1 to VSn, such that, i varying from 1 to n:

$$NGi=VSi+VC,$$

in transmitting the bits of the control word corresponding to the common value VC on the column inputs by simultaneously addressing the n lines I+1 to I+n in respect of the selection of the corresponding cells.

According to a mode of implementation of the process, the specific values VS1 and VS2 possess a common part equal to a predetermined percentage of the lowest grey level.

The subject of the invention is also a device for implementing this process comprising a video processing circuit for processing the video data received, a video memory for storing the processed data, the video memory being linked to column drivers in order to control the column addressing of the plasma panel on the basis of column control words, a control circuit for the line drivers, characterized in that the processing circuit comprises means for calculating specific values and a common value for video data relating to at least two consecutive lines and in that the control circuit of the line drivers simultaneously selects these consecutive lines during the transmission by the column drivers of the bits of the column control words corresponding to the common values.

According to a particular embodiment of the device, the processing circuit also comprises means for coding the specific values in increments of 5 and for calculating a common value minimizing the global coding error corresponding to the difference between the sum of the values to be coded and the sum of the values coded on the basis of this common value, the value calculated being, when several choices are possible, that which makes it possible to distribute the resulting global error over each of the values to be coded.

The subject of the invention is also a process for addressing cells arranged as a matrix array, each cell being situated at the intersection of a line and a column, the array having line inputs and column inputs for displaying grey levels NG defined by video words making up a digital video signal, the column inputs receiving control words for this column, each bit of a control word triggering or not triggering, depending on its state, the selection of the cell of the addressed line and of the corresponding column for a time proportional to the weight of this bit within the word, characterized in that it consists in coding the grey levels NG1 and NG2 relating to an item of information regarding the luminance of two cells situated in the same column and in two adjacent lines I and I+1 as a first control word corresponding to a common value VC and as a second and third control word corresponding to specific values, VS1 and VS2, such that:

$$NG1=VS1+VC$$

$$NG2=VS2+VC$$

in transmitting the bits of the first control word on the column inputs by simultaneously addressing the two lines I and I+1 in respect of the selection of the corresponding cells.

According to a particular mode of implementation of the process, when the coding of the specific values is carried out in an increment different from unity, the common value VC is chosen in such a way as to distribute the resulting error over each of the specific values.

According to a particular mode of implementation of the process, at least one of the weights of the word corresponding to the common value and/or to the specific value is different from a power of two.

According to a particular mode of implementation of the process, the weights of the words for coding the specific value and/or the common value are determined in such a way that identical values to be coded can correspond to different coding words.

According to a particular mode of implementation of the process, when several choices of coding exist, the words chosen are those possessing the lowest high-order bits.

Likewise, according to a particular mode of implementation of the first process described above, the specific control words are themselves split up into control words common to two or more successive lines and these lines are selected during the transmission of these common control words.

The process for coding a grey level of a pixel (or of a cell) is carried out by separation of the information item to be transmitted between a value specific to the pixel to be coded and a value common to this pixel and to the pixel of the adjacent line and same column.

By virtue of the invention, the loss of resolution is curbed. Implementation is simple, making it possible to limit the cost of setup.

BRIEF DESCRIPTION OF THE DRAWINGS

The invention will be better understood and other advantages and characteristics will become clear in reading the following description of a non-limitative embodiment, making reference to the appended figures, of which.

DETAILED DESCRIPTION OF PREFERRED EMBODIMENTS

Figure 1:
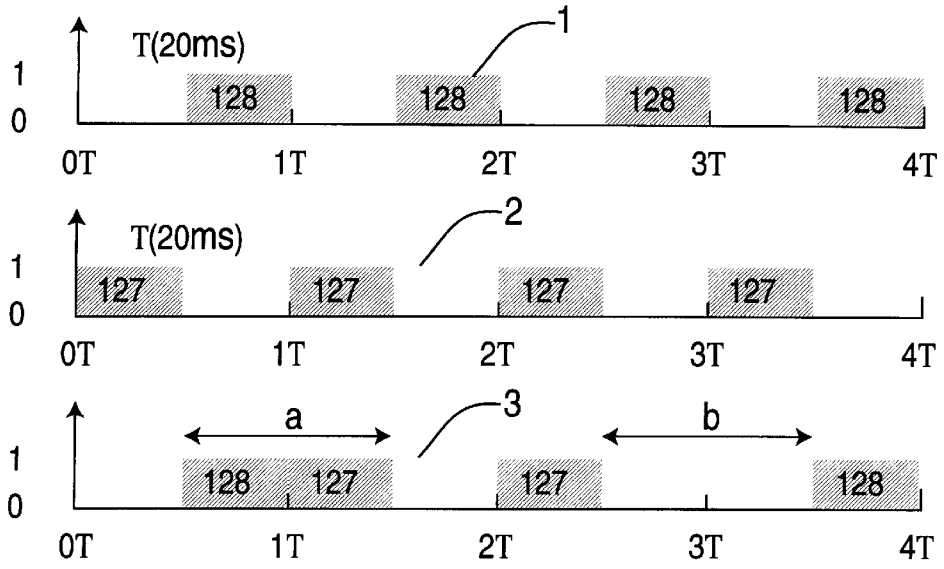
FIG. 1 shows a coding of addressing bits explaining the phenomenon of contouring.

Let us firstly recall the manner of operation of a plasma panel.

A plasma panel consists of two glass panes separated by about a hundred microns. This space is filled with a gaseous mixture containing neon and xenon. When this gas is excited electrically, the electrons orbiting the nuclei are extracted and become free. The term "plasma" denotes this gas in the excited state. Electrodes are silk-screen printed on each of the two panes of the panel, line electrodes for one pane and column electrodes for the other pane. The number of line and column electrodes corresponds to the definition of the panel. During the process of manufacture, a barrier system is set in place which makes it possible physically to delimit the cells of the panel and to limit the phenomena of the diffusing of one colour into another. Each crossover of a column electrode and a line electrode will correspond to a video cell containing a volume of gas. A cell will be referred to as red, green or blue depending on the luminophore deposit with which it will be covered. Since a video pixel is made up of a triplet of cells (one red, one green and one blue), there are therefore three times as many column electrodes as pixels in a line. On the other hand, the number of line electrodes is equal to the number of lines in the panel. Given this matrix architecture, a potential difference merely needs to be applied to the crossover of a line electrode and a column electrode in order to excite a specific cell and thus obtain, point-wise, a gas in the plasma state. The UV generated when exciting the gas will bombard the red, green or blue luminophores and thus give a red, green or blue illuminated cell.

A line of the plasma panel is addressed as many times as are defined therein sub-scans in the grey level information to be transmitted to the pixel, as explained later. The pixel is selected by transmitting a voltage termed a write pulse, by way of a driver, to the whole of the line corresponding to the selected pixel while the information corresponding to the grey-level value of the selected pixel is transmitted in parallel to all the electrodes of the column in which the pixel lies. All the columns are supplied simultaneously, each of them with a value corresponding to the selected pixel of this column.

With each bit of the grey level information there is associated a time information which therefore corresponds to the bit illumination time: a 1 value for a bit of order 4 will thus correspond to the pixel being illuminated for a duration 4 times greater than the illumination corresponding to the bit of order 1. This hold time is defined by the time separating the write cue from an erase cue and corresponds to a hold voltage which specifically makes it possible to maintain the excitation of the cell after its addressing. For a grey level coded on n bits (the grey level for each of the components R G B is involved), the panel will be scanned n times in order to retranscribe this level, the duration of each of these sub-scans being proportional to the bit which it represents. By integration, the eye converts this "global" duration corresponding to the n bits into a value of illumination level. Sequential scanning of each of the bits of the binary word is therefore performed by applying a duration proportional to the weight. The addressing time of A pixel, for one bit, is the same irrespective of the weight of this bit, what changes is the illumination hold time for this bit.

Globally, a cell therefore possesses only two states: excited or non-excited. Therefore, unlike with a CRT, it is not possible to carry out analog modulation of the light level emitted. In order to account for the various grey levels, it is necessary to perform temporal modulation of the duration of emission of the cell within the frame period (denoted T). This frame period is generally divided into as many sub-periods (sub-scans) as there are bits for coding the video (number of bits denoted n). It must be possible to reconstruct all the grey levels between 0 and 255 by combination on the basis of these n sub-periods. The observer's eye will integrate these n sub-periods over a frame period and thus recreate the desired grey level.

A panel is made up of NI lines and Nc columns supplied by NI line drivers and Nc column drivers. The generation of grey levels by temporal modulation requires that the panel be addressed n times for each pixel of each line. The matrix aspect of the panel will enable us to address all the pixels of the same line simultaneously by sending an electrical pulse of level Vccy to the line driver. The signals transmitted to the columns are called column control words and relate to the video signal to be displayed, this relation being for example a transcoding dependent on the number of bits used. The video information corresponding to the bit of this column control word addressed at this instant (corresponding to a sub-scan) will be present on each of the columns and will be manifested by an electrical pulse of "binary" amplitude 0 or Vccx (indicative of the state of the coded bit). Conjugation of the two voltages Vccx and Vccy at each electrode crossover will or will not lead to excitation of the cell. This state of excitation will then be sustained over a duration proportional to the weight of the sub-scan performed. This operation will be repeated for all the lines (NI) and for all the bits addressed (n). It is therefore necessary to address n×NI lines over the duration of the frame, thus giving the following fundamental relation:

$T \geqq n.N_l.t_{ad}$ where $t_{ad}$ is the time required to address a line.

A sequencing algorithm makes it possible to address all the lines n times while, between each addressing, complying with the respective weight of the sub-scan performed.

Let us turn to FIG. 1 to provide a better explanation of the phenomenon of contouring.

In this figure, the abscissa axis represents time and is divided into frame periods of duration T. Each frame period is divided into sub-periods of time whose duration is proportional to the weight of the various sub-scans thus making it possible to define a video level to be displayed on the plasma screen, (1, 2, 4, 8 . . . , 128) for a video quantized on 8 bits and an addressing possessing 8 sub-scans.

The ordinate axis represents the 0 or 1 level of the addressing bits during the corresponding frame periods, or stated otherwise the unlit or lit state of a cell as a function of time, for a given coding level.

Curve 1 corresponds to a coding of the value 128, curve 2 to a coding of the value 127 and curve 3 to a coding of the value 128 during the first frame and of the value 127 during the second frame and vice versa for the next two frames.

The principle of temporal modulation of the grey levels involves a temporal distribution of the n sub-scans which retranscribe the video over the 20 ms of the frame. If addressing on 8 sub-scans (n=8) is adopted, the transitions 127/128 and 128/127 entail a switching over of all the bits. Since the 8 sub-scans are distributed over the 20 ms of the frame, the eye, by integrating the video asynchronously, sees black areas, part b of curve 3 corresponding to a 0 level for the duration of two successive frames, and white areas, part a of curve 3 corresponding to a 1 level for the duration of two successive frames.

The phenomenon of contouring shows up particularly in moving areas where there are strong transitions (contours of objects) or more generally switchovers at the level of the high weights in the coding of this video. In the case of a colour screen, this is manifested by the appearance on the panel, in the region of these contours, of "false colours" due to erroneous interpretation of the triplet R G B. This phenomenon is therefore linked to the system for the temporal modulation of the level of the video and to the fact that the eye, in its role as integrator, gives rise to the appearance of incorrect contours.

A solution to this problem consists in coding the grey level to be transmitted on more bits than are theoretically necessary (8 to code 256 levels) and thus in defining more sub-scans so as to achieve better temporal distribution of the information. This is because, by increasing the number of sub-scans the respective weights of the sub-scans are decreased and the problems during their switchovers are limited. At the present time, given the characteristics of panels (number of lines NI), and the time required to address a line (tad), it is possible to perform 10 sub-scans (n=10) in 20 ms.

A transcoding of the grey level will for example be:

1 2 4 8 16 32 32 32 64 64.

The highest weights can therefore be 64 instead of 128.

A process which is also known makes it possible to "free" sub-scans so as to perform this temporal distribution of the codes even more efficiently. This process consists in copying a bit from line I onto line I+1 by carrying out a common addressing between lines I and I+1 in respect of the relevant bit. Alternatively, it consists in using the same addressing time for the relevant bit, for lines I and I+1 and exciting or not exciting, depending on the value of this bit, the two corresponding cells. By referring to relation (1) it may be observed that by carrying out such addressing, that is to say by decreasing NI, it is possible to increase the value of n. The term tad is a hardware constraint.

The principle of separating the information item between a common value and specific values, which is the subject of our invention, is made explicit below.

The coding of a grey level, which is manifested by a column control word, is performed by taking account not only of the luminance value of the pixel selected but also of the luminance value of the pixel lying in the adjacent line for the same column.

In fact, the column control word, for a given pixel, is separated into two parts, a first control word corresponding to a value common to the two pixels and a second and third control word corresponding to the specific values of the pixels.

It is desired to obtain the following coding:

a value specific to line I coded on n1 bits a value specific to line I+1 coded on n2 bits a value common to lines I and I+1 coded on n3 bits with the following relation:

$$n1+n2+n3=2\times(\text{number of sub-scans per line}).$$

If a given number of sub-scans is considered, it is in fact necessary for the number of sub-scans relating to the bits for coding the two specific values and the common value, namely n1+n2+n3, to correspond to that of the sub-scans performed in a conventional manner and relating to the coding bits for line I and to the coding bits for line I+1.

These various parameters n1, n2, n3 are not fixed. It is possible to modulate the relationship between the definition of the specific values and that of the common value. The better defined are the specific values, the smaller will be the coding-related loss of resolution. Conversely, the less well defined are the specific values, the higher will be the total number of sub-scans. There is therefore a compromise to be found between the loss of resolution on the one hand and the minimization of the defects of display on the other.

The calculation of the specific values is performed as follows:

The specific values for lines I and I+1 contain the information item regarding the difference between these lines I and I+1. This is-because, if NG1 and NG2 denote the grey levels of the pixels of lines I and I+1, VS1 and VS2 their specific values and VC the common value, the following relation holds:

$$NG1=VS1+VC$$

$$NG2=VS2+VC$$

Consequently, VS1−VS2 must be equal to NG1−NG2 (so as always to have zero coding error). When this difference between NG1 and NG2 (denoted D) has been determined, VS1 and VS2 are calculated by adding the term D and a portion a of the lowest grey level.

We then have:

$$\text{if } NG1>NG2 VS1=D+\alpha NG2$$

$$VS2=\alpha NG2$$

$$\text{if } NG2>NG1 VS1=\alpha NG1$$

$$VS2=D+\alpha NG1$$

The value of $\alpha$ is a parameter to be defined in the same way as n1, n2, n3. This value a is the result of algorithmic tests and is therefore partly determined empirically. The value is chosen as a function of the calculations induced, for example the value 3/16 facilitating the calculations by the digital signal processor DSP.

The common value is calculated by differencing the initial value and the specific value. Given the approximations made in the calculation of the specific values, the common value is obtained through the following calculation:

$$VC=\tfrac{1}{2}\times(NG1+NG2-VS1-VS2)$$

The calculations are therefore summarized by the following steps:

determination of the value D corresponding to the difference between the two values to be coded NG1 and NG2, calculation of the specific values VS1 and VS2 as a function of D, α and NG1 or NG2, calculation of the common value VC as a function of NG1, NG2, VS1, VS2.

An important point consists in the minimization of the recoding error. To be able to minimize this recoding error, use will be made of a particular coding of the specific value. This is a coding in increments of 5, that is to say each code is a multiple of 5. The following table shows how the specific and common values are calculated to obtain, finally, the values VF1 and VF2 which are the closest possible to NG1 and NG2. In fact, the error (E1, E2) is limited to +/−1.

| NG1 | NG2 | D | D by 5 | VS1 | VS2 | VC | VF1 | VF2 | E1 | E2 |
|---|---|---|---|---|---|---|---|---|---|---|
| 60 | 65 | 5 | 5 | 10 | 15 | 50 | 60 | 65 | 0 | 0 |
| 60 | 66 | 6 | 5 | 10 | 15 | 50 | 60 | 65 | 0 | −1 |
| 60 | 67 | 7 | 5 | 10 | 15 | 51 | 61 | 66 | 1 | −1 |
| 60 | 68 | 8 | 10 | 10 | 20 | 49 | 59 | 69 | −1 | 1 |
| 60 | 69 | 9 | 10 | 10 | 20 | 49 | 59 | 69 | −1 | 0 |

The difference D between the grey values is coded on the basis of the closest multiple of 5 of this value D. The specific values VS1 and VS2 are multiples of 5 and the proportion of the specific value with respect to the global value (the parameter α) is chosen to be equal to 3/16. The value of VS1 is thus the value modulo 5 which comes closest to 60×3/16.

The specific value, which contains the information item regarding the difference between the two coded pixels, is defined only over a restricted number of bits. The maximum difference which it will be possible to code will therefore be limited in fact to the maximum value which can be coded as a specific value. This will therefore prohibit us from coding large differences. This limitation is, however, not inconvenient, in so far as this system of coding is performed on a video signal which generally possesses a fairly small vertical definition.

For a strong transition, since the difference which can be coded is limited, one of the specific values will be equal to the maximum value and the other will be equal to zero. The common value will be determined in such a way as to minimize the error in the final value. In this case, the final error may be greater than 1.

The following table gives an example of a coding between two pixels whose difference is greater than the maximum definition of the specific value. The maximum value chosen for the specific value is taken to be equal to 70:

| NG1 | NG2 | D | D by 5 limited | VS1 | VS2 | VC | VF1 | VF2 | E1 | E2 |
|---|---|---|---|---|---|---|---|---|---|---|
| 10 | 100 | 90 | 70 | 0 | 70 | 20 | 20 | 90 | 10 | −10 |

An example application is given below for a system allowing 10 sub-scans:

Definition of the parameters:

n1=4 (code 5,10,20,35)

n2=4 (code 5,10,20,35)

n3=12 (code 1,2,4,6,9,12,15,19,23,27,31,36)

α=3/16

This allows us in fact to transcribe a grey level as 16 sub-scans, 12 sub-scans being common to two lines and 4 sub-scans being specific. In this case, the gain will be 6 sub-scans with a recoding error of less than or equal to 1 (for a difference between lines of less than or equal to 70).

A second example application is given below for a system allowing 8 sub-scans:

Definition of the parameters:

n1=4 (code 5,10,20,40)

n2=4 (code 5,10,20,40)

n3=8 (code 2,4,8,16,32,38,40,40)

α=3/16

This allows us in fact to transcribe a grey level as 12 sub-scans, 8 sub-scans being common to two lines and 4 sub-scans being specific. In this case, the gain will be 4 sub-scans with a recoding error of less than or equal to 1 (for a difference between lines of less than or equal to 75).

It should be noted that the fact that an acceptable result is obtained at the level of the quality of the image, by using only 8 sub-scans whereas 10 are possible, can be exploited in various ways:

increase in the number of lines addressed insertion of addressing-free sustain cycle so as to increase the brightness of the screen insertion of cycle so as to promote the priming of the cells etc.

The 4 bits of the words for coding the specific values code values between 0 and 70 (or 75) and the 12 (or 8) bits of the words for coding the common values code values lying between 0 and 185 (or 180) in the two examples given. The choice of the weights of these coding words is made in such a way as to avoid the high weights so as to limit the contouring problems. In fact, the choice is made in such a way as to best distribute, from a statistical point of view, the information over the 20 ms of scanning.

Transferring a proportion of the lowest grey value to be coded into the specific value part (that is to say choosing a different from zero) or, stated otherwise, transferring a part of the value common to the two grey values to be coded into the specific value part, has several advantages:

this distributing of the common value to be coded over the common part VC and the specific part VS makes it possible to extend the coding span of the common value to be coded, which is no longer limited to the maximum value of VC. For example, for a maximum specific value, $VS_m$, equal to 70 and therefore a maximum value VC, $VC_m$, equal to 255−70=185, it is theoretically possible to code a maximum common value equal to $VC_m+\alpha.(VC_m+VS_m)=185+3/16.\ 255=233$. Of course, this distribution is effected when the difference between the two grey values to be coded is less than $VS_m$. In the converse case, the values will be chosen in such a way as to minimize the final errors, as indicated earlier, this distributing makes it possible to limit the use of the high weights of VC and hence to decrease the contouring effects.

The choice of the maximum specific value, 70 or 75 in our examples, takes account of the correlation between the lines of an image. Statistically, for a television type image, fewer than 5% of cases give a difference greater than 70 and this is the reason for our choice. Of course, this choice can be adapted to the type of image to be displayed and the higher the correlation between two successive lines, statistically speaking, the smaller it will be possible to make the value.

A variant of the invention consists in a cascading of codings, that is to say a generalization of the process previously described by selecting a greater number of lines than two for coding the common value, for example four lines of the panel.

This case involves cascading the codings and thus involves coding 4 lines at the same time. In the case of 8 available sub-scans, corresponding to the displaying of a column control word of 8 bits during a conventional scan, it is possible to distribute the coding as follows:

VS1: specific value for line I (4 bits)

VS2: specific value for line I+1 (4 bits)

VS3: specific value for line I+2 (4 bits)

VS4: specific value for line I+3 (4 bits)

VC12: common value for lines I and I+1 (4 bits)

VC34: common value for lines I+2 and I+3 (4 bits)

VC1234: common value for lines I, I+1, I+2 and I+3 (8 bits).

Specific values for each of the four lines, common values in groups of 2 lines and a common value for the 4 lines are thus obtained. Globally, a grey level will thus be reconstructed by 16 sub-scans (number of bits required for coding a line=4+4+8) with an initial capacity of 8 sub-scans (32 bits to code 4 lines).

It would be possible to extend this technique to a coding on 8 lines by cascading the coding once again.

Figure 2:
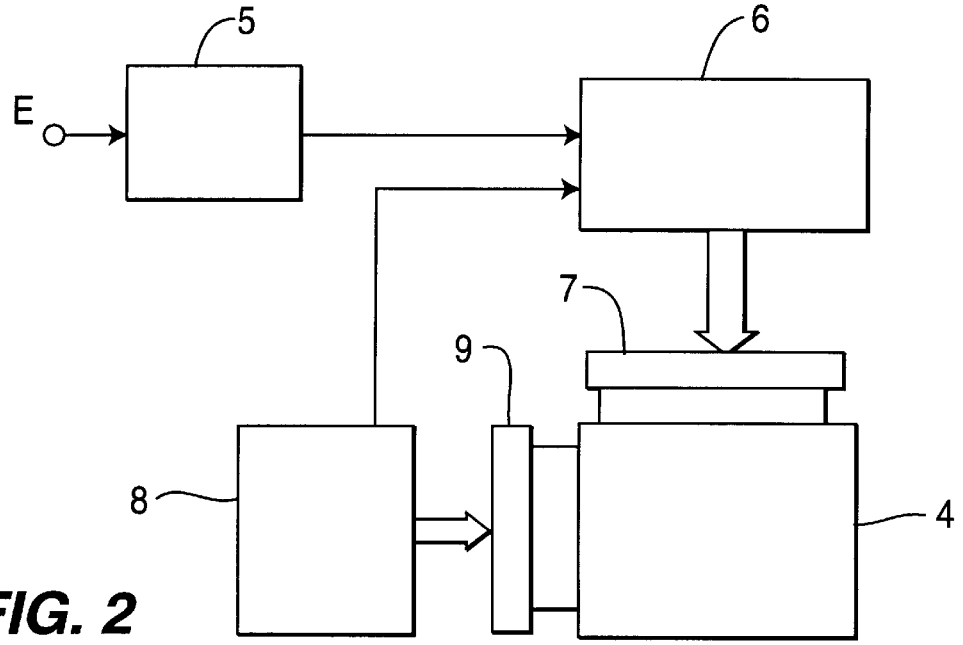
FIG. 2 shows a block diagram of an addressing device.

An example embodiment of the addressing device is described in FIG. 2 which represents a simplified diagram of the control circuits of a plasma panel 4.

The digital video information arrives at the input E of the device which is also the input of a video processing circuit 5. This circuit is linked to the input of a video memory 6 which will transmit the stored information to the input of a circuit 7 grouping together the column drivers.

A scan generator 8 transmits synchronizing information to the video memory 6 and controls a circuit 9 grouping together the line drivers.

The video information coded on 8 bits and received on the input E of the device is thus processed by the processor. The latter carries out a transcoding of these video words 8 so as to calculate a common value and a specific value for each of these video words. This information is transmitted to the image memory 6 which will store it in such a way as to provide, in the right order, the bits corresponding to the various types of sub-scan. The image memory 6 thus transmits, bit after bit, the words corresponding to the common values when the control circuit 9 selects the lines two by two, then transmits the specific values when the control circuit 8 selects the corresponding lines, this time one after the other.

The link between the lines management circuit and the image memory 6 makes it possible to synchronize the transmission of the successive bits of the column control words, consisting of the specific values and of the common values, together with the line scan.

The circuit 9 provides the addressing voltage-and also the holding voltage over the duration corresponding to the sub-scan relating to the weight of the bit sent on the columns for this addressing. This set of operations is carried out on each of the three components RGB.

Figure 3:
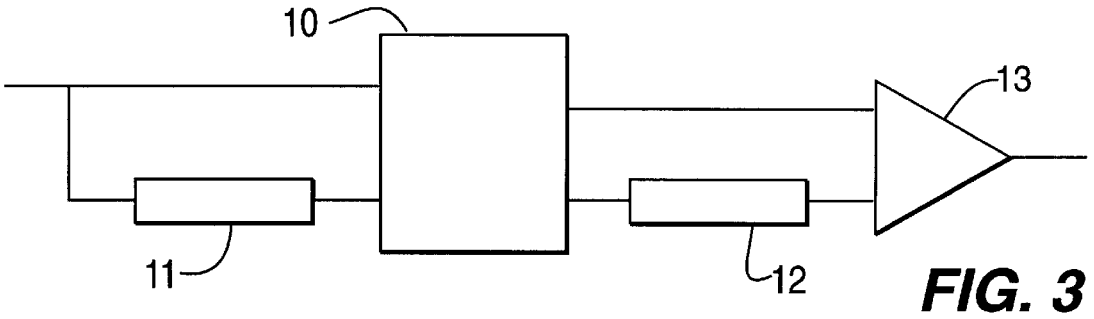
FIG. 3 shows a block diagram of a device for calculating the specific value and the common value of the coding words.

FIG. 3 describes, in a more detailed manner, the device for calculating the specific value and the common value of the coding words, which device is an integral part of the video processing circuit 5.

The video words are received, on the input of the calculating device, in the order corresponding to a television scan. They are transmitted, in parallel, on the input of a circuit 10 for calculating the specific and common values and on the input of a line memory circuit 11. The latter circuit makes it possible to delay the signals by a line duration and its output is linked to a second input of the circuit for calculating the specific and common values. Thus, the circuit 10 receives simultaneously on its inputs the value to be coded of a pixel, for example of line I+1 originating directly from the input of the calculating device and the value of a pixel of line I originating from the output of the line memory. The circuit 10 calculates, in a known manner, the specific and common values of these two values to be coded, as a function of the predetermined parameters, namely the number of coding bits, their weight and the value of $\alpha$. These calculated values are then transmitted simultaneously, for line I, on a first output linked to the output routing circuit 13, and for line I+1, on a second output linked to a second line memory 12, itself linked to the output routing circuit 13.

The calculated values corresponding to two consecutive lines are coded, in our example, on 20 bits, 12 bits for the common value and 4 bits for each of the specific values. The line memory 12 stores 10 bits, for example 4 bits of the specific value of the pixels of line I+1 and 6 bits of the common value. The 10 bits available on the first output are transmitted to the routing circuit and the 10 bits available on the second output are stored in the line memory 12. Thus, the routing circuit makes it possible to transmit to the image memory, for example during the reception, by the calculating device, of the even lines, the 10 bits available on the first output of the calculating circuit and, during the reception of the odd lines, the 10 bits available on the output of the second line memory (the calculations are performed by the circuit 10 at half the line frequency).

The above-described functions can be carried out by a digital signal processing circuit (DSP) dedicated to the video. For example, the reference circuit SVP from the manufacturer TEXAS INSTRUMENT possesses internally the line memories, can carry out the calculations of the specific and common values and can also perform the routing of output between the specific and common values.

Of course, the above description assumed a line selection of the plasma panel for a transmission of video information on the column inputs of the display, but other types of addressing could be envisaged, for example by reversing the function of the lines and columns without the process departing from the field of the invention.

Clearly, the invention is not limited by the number of bits which quantize the digital video signal to be displayed, nor the number of sub-scans.

It may be applied equally to any type of screen or device with matrix addressing which utilizes modulation of the temporal type for the displaying of luminance or grey levels corresponding to each of the three components R G B. The cells of this device or matrix array with line inputs and column inputs, here the term cell being taken in the broad sense of elements at the intersection of the lines and columns, may be cells of plasma panels or else micromirrors of micromirror circuits. Instead of emitting light directly, these micromirrors reflect received light in a pointwise manner (a cell corresponding to a micromirror), when they are selected. Their addressing in respect of selection is then identical to the addressing of the cells of plasma panels such as is described in the present application.

What is claimed is:

1. Process for addressing cells arranged as a matrix array, each cell being situated at the intersection of a line and a column, the array having line inputs and column inputs for displaying grey levels NG defined by video words making up a digital video signal, the column inputs receiving control words for this column, each bit of a control word triggering or not triggering, depending on its state, the selection of the cell of the addressed line and of the corresponding column for a time proportional to the weight of this bit within the word, comprising the steps of:

coding the grey levels NG1 and NG2 relating to an item of information regarding the luminance of two cells situated in same column and in two adjacent lines I and I+1 as a first control word corresponding to a common value VC and as a second control word and a third control word corresponding to specific values, VS1 and VS2, such that:

$$NG1=VS1+VC$$

$$NG2=VS2+VC; \text{ and}$$

transmitting the bits of the first control word on the column inputs by simultaneously addressing the two lines I and I+1 in respect of the selection of the corresponding cells.

2. Process according to claim 1, wherein the specific values VS1 and VS2 possess a common part equal to a predetermined percentage of the lowest grey level.

3. Process according to claim 2, wherein this percentage is equal to 3/16.

4. Process according to claim 1, wherein the coding of the grey levels comprise the following steps:

calculation of the specific value $VS1=\alpha\times NG1$ on the basis of the value of the lowest grey level NG1 and of a predetermined ratio $\alpha$, calculation of the value D corresponding to the difference between the two values to be coded NG1 and NG2, calculation of the specific value VS2 such that $VS2=D+\alpha\times NG1$; and calculation of the common value $VC=\frac{1}{2}(NG1+NG2-VS1-VS2)$.

5. Process according to claim 4, wherein the value of D taken into account is a multiple of 5 which comes closest to the value $|NG1-NG2|$ and in that the coding of the specific values is carried out in increments of 5.

6. Process according to claim 1, wherein when the coding of the specific values is carried out in an increment different from unity, the common value VC is chosen in such a way as to distribute the resulting error over each of the specific values.

7. Process according to claim 1, wherein at least one of the weights of the word corresponding to the common value and/or to the specific value is different from a power of two.

8. Process according to claim 1, wherein the weights of the words for coding the specific value and/or the common value are determined in such a way that identical values to be coded can correspond to different coding words.

9. Process according to claim 8, wherein when several choices of coding exist, the words chosen are those possessing the lowest high-order bits.

10. Process for addressing cells arranged as a matrix array, each cell being situated at the intersection of a line and a column, the array having line inputs and column inputs for displaying grey levels NG defined by video words making up a digital video signal, the column inputs receiving control words for this column, each bit of a control word triggering or not triggering, depending on its state, the selection of the cell of the addressed line and of the corresponding column for a time proportional to the weight of this bit within the word, comprising the steps of:

splitting up the grey levels NG1, NG2, . . . , NGn relating to an information item regarding the luminance of n cells situated in the same column and in consecutive lines I+1 to I+n into at least one control word corresponding to a value common to the n lines, VC, and n control words corresponding to values specific to each line, VS1 to VSn, such that i varying from 1 to n:

$$NGi=VSi+VC; \text{ and}$$

transmitting the bits of the control word corresponding to the common value VC on the column inputs by simultaneously addressing the n lines I+1 to I+n in respect of the selection of the corresponding cells.

11. Process according to claim 10, wherein the specific control words are themselves split up into control words common to two or more successive lines and in that these lines are selected during the transmission of these common control words.

12. Process according to claim 10, wherein the specific values VSi possess a common part equal to a predetermined percentage of the lowest grey level.

13. Process according to claim 1, wherein the cells are cells of a plasma panel and in that selection involves the illuminating of the cell.

14. Process according to claim 1, wherein the cells are micromirrors of a micromirror circuit.

15. Device for implementing the process according to claim 1 comprising a video processing circuit for processing the video data received, a video memory for storing the processed data, the video memory being linked to column drivers in order to control the column addressing of the plasma panel on the basis of column control words, a control circuit for the line drivers wherein the processing circuit comprises means for calculating specific values and a common value for video data relating to at least two consecutive lines and wherein the control circuit of the line drivers simultaneously selects these consecutive lines during the transmission by the column drivers of the bits of the column control words corresponding to the common values.

16. Device according to claim 15, wherein the means comprise lines memories.

17. Device according to claim 15, wherein the processing circuit also comprises means for coding the specific values in increments of 5 and for calculating a common value minimizing the global coding error corresponding to the difference between the sum of the values to be coded and the sum of the values coded on the basis of this common value, the value calculated being, when several choices are possible, that which makes it possible to distribute the resulting global error over each of the values to be coded.

* * * * *